US008573447B2

(12) United States Patent
Muderlak et al.

(10) Patent No.: US 8,573,447 B2
(45) Date of Patent: Nov. 5, 2013

(54) DISPENSING SYSTEM

(75) Inventors: Ken Muderlak, Milwaukee, WI (US); Todd Muderlak, Whitefish Bay, WI (US)

(73) Assignee: Dispensing Dynamics International, City of Industry, CA (US)

( * ) Notice: Subject to any disclaimer, the term of this patent is extended or adjusted under 35 U.S.C. 154(b) by 231 days.

(21) Appl. No.: 13/065,225

(22) Filed: Mar. 17, 2011

(65) Prior Publication Data

US 2011/0226805 A1 Sep. 22, 2011

Related U.S. Application Data

(60) Provisional application No. 61/315,234, filed on Mar. 18, 2010, provisional application No. 61/411,802, filed on Nov. 9, 2010.

(51) Int. Cl.

| | |
|---|---|
| ***B67B 1/00*** | (2006.01) |
| ***B65D 88/54*** | (2006.01) |
| ***G01F 11/00*** | (2006.01) |
| ***B67D 1/00*** | (2006.01) |
| ***B67D 7/14*** | (2010.01) |

(52) U.S. Cl.
USPC ..... 222/153.03; 222/153.11; 222/325; 222/52

(58) Field of Classification Search
USPC ..... 222/52, 63, 182–183, 153.03, 153.11, 222/325, 402.1, 402.13, 504, 645–649
See application file for complete search history.

(56) References Cited

U.S. PATENT DOCUMENTS

| | | | | | |
|---|---|---|---|---|---|
| 1,929,334 | A | * | 10/1933 | Sabatine | 81/3.32 |
| 3,150,800 | A | * | 9/1964 | Weber, III | 222/647 |
| 3,214,062 | A | * | 10/1965 | Mahon | 222/649 |
| 3,659,791 | A | * | 5/1972 | Clark | 239/375 |
| 3,889,852 | A | * | 6/1975 | Strefford | 222/153.03 |
| 4,040,543 | A | * | 8/1977 | Guillen | 222/473 |
| 4,098,436 | A | * | 7/1978 | Kohlbeck | 222/182 |
| 4,111,338 | A | * | 9/1978 | Cheng et al. | 222/180 |
| 4,171,776 | A | * | 10/1979 | Pagliaro | 239/274 |
| 4,579,258 | A | * | 4/1986 | Brown et al. | 222/323 |
| 4,615,476 | A | * | 10/1986 | Hobbs et al. | 222/153.09 |
| 4,789,083 | A | * | 12/1988 | Gutierrez | 222/108 |
| 5,025,962 | A | * | 6/1991 | Renfro | 222/649 |

(Continued)

FOREIGN PATENT DOCUMENTS

JP 2003012062 6/2001

OTHER PUBLICATIONS

Print-out of page fgrom web site of Eachome Houseware (HK) Co., Ltd.

*Primary Examiner* — Paul R Durand
*Assistant Examiner* — Vishal Pancholi
(74) *Attorney, Agent, or Firm* — Thomas R. Lampe

(57) ABSTRACT

A dispensing system includes a container securing mechanism configured to secure a container in a fully engaged position suitable for dispensing a substance held within the container and further configured to release the container from the fully engaged position upon the actuation of a container release actuator. The system can further include a container stop mechanism configured to stop the container in a disengaged position upon release of the container from the container securing mechanism, the disengaged position being between the fully engaged position and a position in which the container is fully released from the system. The system can include a movable multiple use hammer assembly that functions to automatically release the container from the system under predetermined conditions.

20 Claims, 10 Drawing Sheets

(56) References Cited

U.S. PATENT DOCUMENTS 5,193,557 A * 3/1993 Hogan ..... 132/112
5,673,825 A * 10/1997 Chen ..... 222/646
5,713,492 A * 2/1998 DeGennaro ..... 222/153.03
5,884,808 A * 3/1999 Muderlak et al. ..... 222/23
5,904,273 A * 5/1999 Aspacher et al. ..... 222/402.15
6,318,600 B1 * 11/2001 Winnett et al. ..... 222/173
6,540,155 B1 * 4/2003 Yahav ..... 239/70
6,929,154 B2 * 8/2005 Grey et al. ..... 222/153.03
7,246,724 B2 * 7/2007 Dave ..... 222/325
7,299,951 B2 * 11/2007 Jahnke et al. ..... 222/179
7,631,783 B1 * 12/2009 Laible ..... 222/153.04
7,815,074 B2 * 10/2010 Ciavarella et al. ..... 222/153.09
7,854,354 B2 * 12/2010 Laible ..... 222/325
2010/0025427 A1 * 2/2010 Chiou et al. ..... 222/1

* cited by examiner

DISPENSING SYSTEM

This application is based on and claims the benefit of U.S. Provisional Patent Application Ser. No. 61/315,234, filed Mar. 18, 2010, and of U.S. Provisional Patent Application Ser. No. 61/411,802, filed Nov. 9, 2010.

TECHNICAL FIELD

The present invention relates to a dispensing system for use with a container for dispensing substances wherein the container can be inserted in and removed from the system along a vertical axis. The invention has particular, but not exclusive, application to the dispensing of aerosols.

BACKGROUND OF THE INVENTION

It is well known to employ pressurized canisters and other pressurized containers to deliver fragrances, de-odorizers and many other substances. It is also known to provide housings for temporarily accommodating such containers. Timers and other controls have been employed to control dispensing. The following patent documents illustrate systems believed to be representative of the current state of the prior art in this field: U.S. Pat. No. 7,815,074, issued Oct. 19, 2010, U.S. Pat. No. 7,854,354, issued Dec. 21, 2010, U.S. Pat. No. 7,631,783, issued Dec. 15, 2009, U.S. Pat. No. 7,299,951, issued Nov. 27, 2007, U.S. Pat. No. 6,318,600, issued Nov. 20, 2001, U.S. Pat. No. 5,193,557, issued Mar. 16, 1993, U.S. Pat. No. 4,789,083, issued Dec. 6, 1988, U.S. Pat. No. 4,615,476, issued Oct. 7, 1986, U.S. Pat. No. 4,171,776, issued Oct. 23, 1979, U.S. Pat. No. 4,111,338, issued Sep. 5, 1978, and Japanese Patent App. No. JP2003012062, dated Jun. 29, 2001.

Eachome Houseware (HK) Co., Ltd makes available a number of aerosol dispensers utilizing canister housings, timers and other controls, a movable front cover allowing access to the housing interior for replacing canisters.

DISCLOSURE OF INVENTION

One embodiment of the invention provides a system for dispensing substances from a container such as a canister. The substances can be gases, liquids, and/or solids. For example, in some embodiments the substance is in the form of an aerosol. The system is intended to be mounted on a wall and allows for insertion and removal of a container preferably from the bottom and along a substantially vertical axis. The system includes a container securing mechanism configured to secure a container in a fully engaged position suitable for dispensation of the container substance (e.g., aerosol dispensation) and further configured to release the container from the fully engaged position upon the actuation of a container release actuator, which can occur automatically. Upon release, the container falls in a vertical direction due to gravity. The system can also include a container stop mechanism configured to stop the container in a disengaged position upon release of the container from the container securing mechanism, and this prevents the container from falling to the floor. The disengaged position can be between the fully engaged position and a position in which the container is fully released from the system. In addition, the container stop mechanism supports the installation process of the container by ensuring the container can be fully inserted into the dispensing system with minimal effort.

The system can also include a housing to partially or fully conceal the container when it is in the fully engaged position, and to partially or fully conceal the container when it is in the disengaged position. For example, in some embodiments, the housing and the container securing mechanism are configured to secure a container completely or partially within the housing when the container is in the fully engaged position. In some embodiments, the housing and the container stop mechanism are configured such that at least a portion of the container extends outside the housing when the container is in the disengaged position.

One illustrative example of a container securing mechanism comprises an expandable retaining ring configured to engage a recessed track around the circumference of a container. The expansion of the ring can be actuated by, for example, operation of a key or a button. The securing mechanism can also be automatically actuated, using for example electronics and/or an electromechanical mechanism.

In some embodiments, a hammer assembly can operate to actuate the release of material from the container, and to automatically actuate the release of the container from the container securing mechanism.

In some embodiments, the container stop mechanism is a friction-based mechanism. For example, the container stop mechanism may include flexible plastic or a gasket or 0-ring adapted to fit around the container and provide one or more continuous or discontinuous points of contact.

In some embodiments, the container stop mechanism comprises a ring configured to engage the container, and a support structure formed as part of the housing. In this embodiment, the ring can be movably connected to the support structure such that the ring moves with the container along a vertical axis corresponding to the direction of container insertion and release.

A method of using an aerosol dispensing system having a container secured in a fully engaged position includes a step of releasing the container from a container securing mechanism by actuating a container release actuator (manually or automatically), whereby a container stop mechanism stops the released container in a disengaged position, which is between the fully engaged position and a fully released position. When the container is released, the container drops in a vertical direction below the container securing mechanism.

Another method of using an aerosol dispensing system of the type described herein includes the step of inserting a container into a container stop mechanism, releasing the container such that it is held in a disengaged position by the container stop mechanism, and subsequently further inserting the container into a container securing mechanism to a fully engaged position. The container is inserted along a vertical axis preferably from below the container stop mechanism and the container securing mechanism.

Other aspects and embodiments are contemplated and considered within the scope of the invention.

BRIEF DESCRIPTION OF THE DRAWINGS

Embodiments of the invention are disclosed with reference to the accompanying drawings and are for illustrative purposes only. The invention is not limited in its application to the details of construction or the arrangement of the components illustrated in the drawings. The invention is capable of other embodiments or of being practiced or carried out in other various ways. The drawings illustrate a best mode presently contemplated for carrying out the invention. Like reference numerals are used to indicate like components.

In the drawings.

MODES FOR CARRYING OUT THE INVENTION

Although the following detailed description focuses on a dispensing system for aerosols, dispensing systems adapted for the dispensation of other forms of liquids, gases and/or solids are also contemplated.

Figure 1:
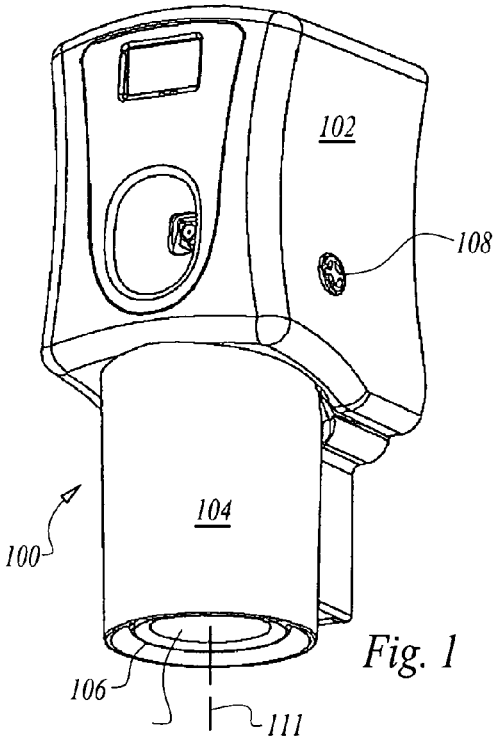
FIG. 1 is a perspective view of an exemplary aerosol dispensing system in which an aerosol container is in a fully engaged position within a system housing.

FIG. 1 shows a perspective view of an exemplary aerosol dispensing system 100. This system can be used to dispense a variety of fragrance technologies, such as aerosol propellants, and is preferably mounted on an upper part of a wall and is preferably battery powered. This system 100 allows for a container 112 to be inserted in and removed from the system along a substantially vertical axis 111 in a quick and simple manner such that an empty container can be easily removed and a filled container can be easily inserted. The container 112 can be in the form of a canister or other package. In the illustrated system 100, a container is inserted in and removed from the bottom of the system, although in other embodiments, a container can be inserted in and/or removed from a top of the system.

Figure 2:
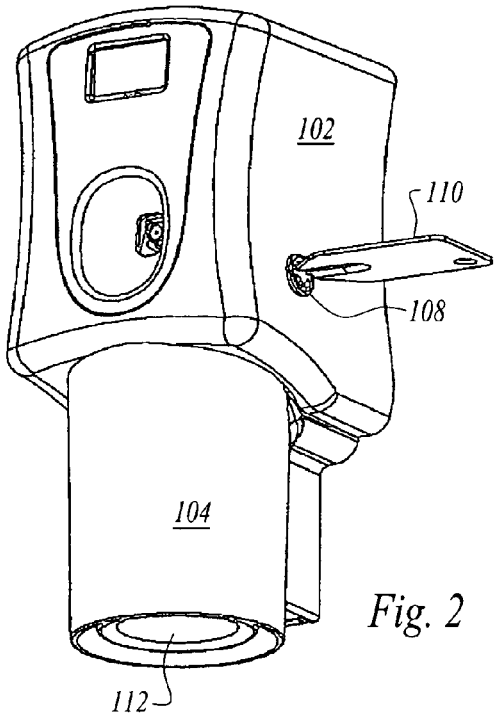
FIG. 2 is an illustration of the aerosol dispensing system of FIG. 1 showing a key engaged with a container release actuator.
Figure 3:
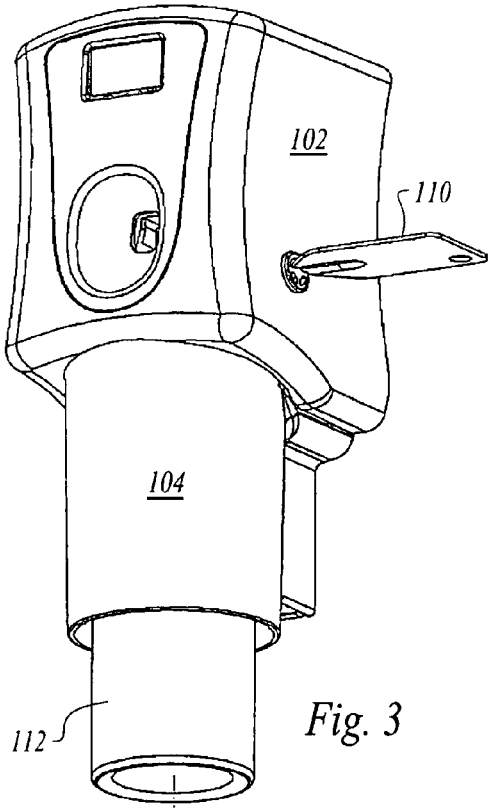
FIG. 3 is an illustration of a container in a disengaged position after the container is partially released from the aerosol dispensing system of FIG. 2 and supported by the container stop mechanism.

As shown in FIGS. 1-3, the exemplary system 100 includes a two-part housing comprising an upper cover 102 configured to cover the aerosol spray mechanism and a lower cover 104 configured to cover at least a portion of the aerosol container 112. In some embodiments, the entire housing, upper cover, and/or lower cover are absent. The presence of a housing can provide an aesthetically pleasing look and in particular, the upper cover can be advantageous from a security standpoint because it can prevent the release of a secured container. The presence of a lower cover can be advantageous in that it can form part of a container stop mechanism and can operate as a guide for insertion and removal of the container 112. The absence of a lower cover can be advantageous from a branding standpoint because graphics and/or text can be placed on the container to be easily viewable by room occupants.

Figure 4:
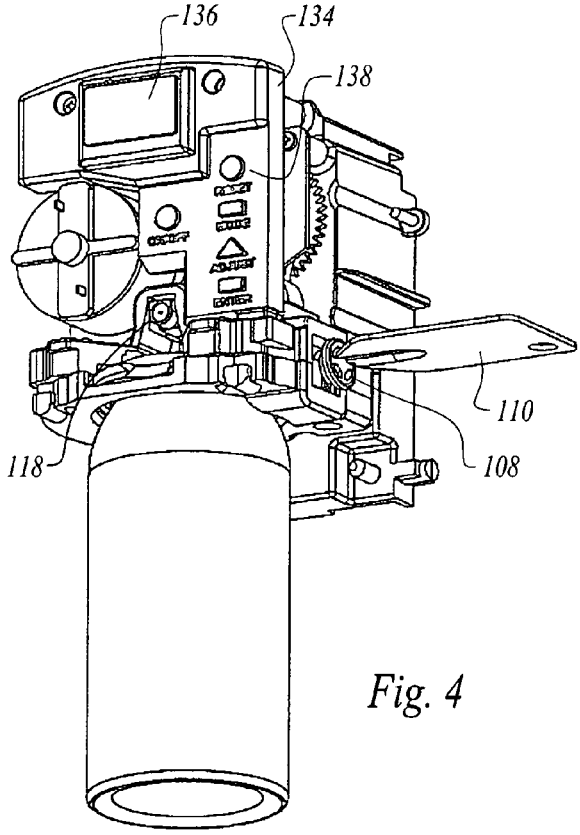
FIG. 4 is an illustration of the aerosol dispensing system of FIG. 2 with the lower cover and the upper cover of the system housing removed.

As shown in FIG. 4, a container securing mechanism 114 secures the container 112 in place in a fully engaged position. A container release actuator 108 is accessible through the housing and interacts with the container securing mechanism 114 such the container 112 can be released from its fully engaged (secured) position. The container can be released manually, although the system 100 can also include an automatic release feature. When the container is released, it moves downward due to gravity, and a container stop mechanism 122 (shown in FIG. 5) stops the container in a disengaged position, which is not a fully released position. The container stop mechanism 122 also operates to stop the container in the disengaged position when a container 112 is first inserted in the system 100. A container refill port 106 (see FIG. 1) formed in the lower cover 104 and located at the bottom of the dispensing system can serve as a guide for insertion or removal of the aerosol container 112.

The container release actuator 108 for releasing the container from the container securing mechanism can be manually or automatically actuated, with manual operation taking the form of a "no key" (e.g., a button for finger activation) or a "keyed" mechanism, and automatic operation including the use of a hammer assembly. FIG. 2 for example shows the insertion of a key 110 to release the aerosol container 112 from the system 100. The key 110 can be of any design to maximize or minimize a desired level of security. FIG. 3 illustrates the release of the aerosol container 112 upon the actuation of the key 110.

More specifically, FIG. 4 shows an interior view of the dispensing system 100 of FIG. 1 with the upper cover and lower cover removed. Here, the aerosol container 112 is fully inserted in the housing, such that it engages the container securing mechanism 114, which is configured to secure or "lock" the container in place. As shown in FIG. 4, the container securing mechanism 114 is in operable communication with the container release actuator 108. A more detailed description of the container securing mechanism is provided in association with FIGS. 5-8. When the container is fully inserted into the system 100, its aerosol spray head 118 is aligned with an opening 120 that extends through the upper cover 102 of the housing and allows an aerosol spray (or other substance) to exit the dispensing system when a spray actuator, such as a pump head, is actuated.

Figure 5:
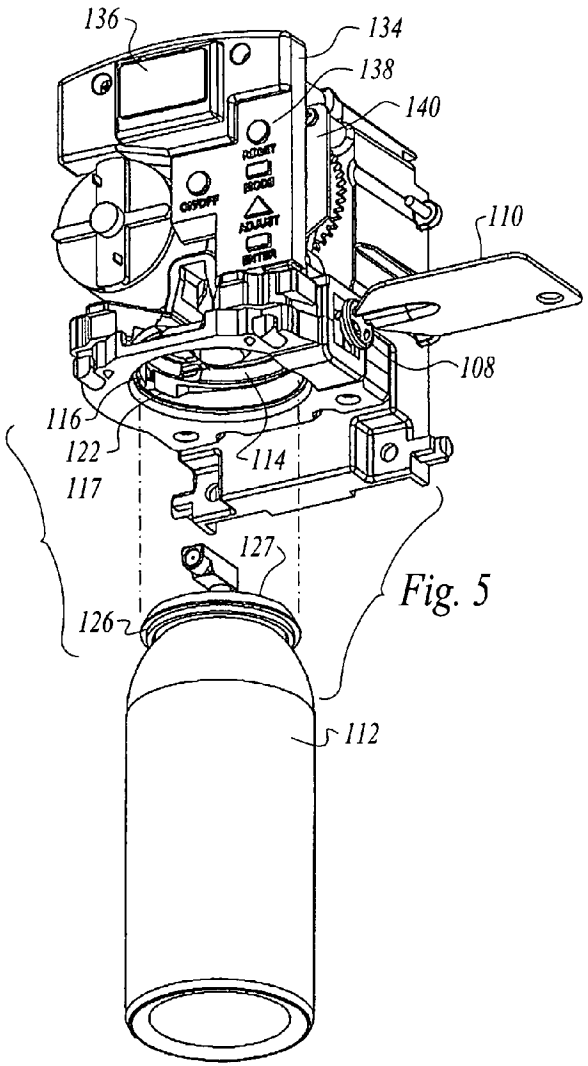
FIG. 5 is an illustration of the aerosol dispensing system of FIG. 3 with the lower cover and the upper cover of the system housing removed and the container in the fully released position.

FIG. 5 shows the aerosol dispensing system 100 of FIG. 4 with the aerosol container released therefrom. The container stop mechanism 122 can be in the form of a friction fit between the container 112 and a surrounding portion of the system 100. For example, the container stop mechanism 122 can include for example an o-ring or rubber gasket that is provided in a container refill channel 116 formed in a substrate plate 117 immediately below the container securing mechanism 114. The container stop mechanism 122 can also take the form of some type of friction fit that occurs for example between the container 112 and one or more contact areas along the container refill port 106.

When a container has been stopped, a user can simply pull the container 112 fully from the aerosol dispensing system to a fully released position such as illustrated in FIG. 5. The stop mechanism 122 also assists the user in the replacement of the container. For example, a user can push a new or refilled container in the housing until it engages with the stop mechanism 122. Then, the user can release the container 112 with no worry of it falling away from the aerosol dispensing system 100. The user can then push the container into the housing until it is fully in place in a fully engaged position and secured by the container securing mechanism 114 within the protective housing.

Figure 9C:
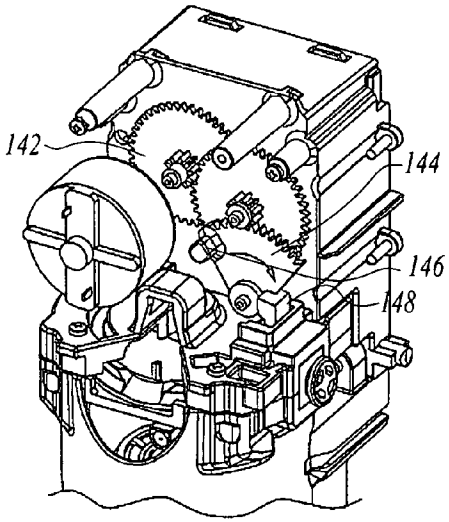
FIG. 9C is an illustration of the aerosol dispensing system of FIG. 5 with the user interface component and control circuit removed and shows a second hammer head of the hammer assembly which has been moved down and to the right from the position illustrated in FIG. 9A such that it can automatically expand a retaining ring for releasing the container from the container securing mechanism.
Figure 9B:
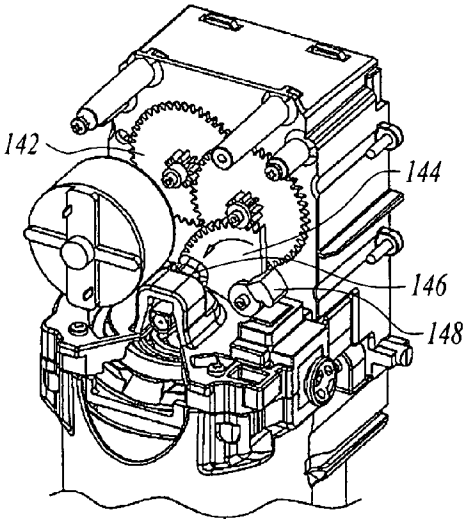
FIG. 9B is an illustration of the aerosol dispensing system of FIG. 5 with the user interface component and control circuit removed and shows a first hammer head of the hammer assembly which has been moved down and to the left from the position illustrated in FIG. 9A such that it can hit an actuator for releasing material from the container.
Figure 9A:
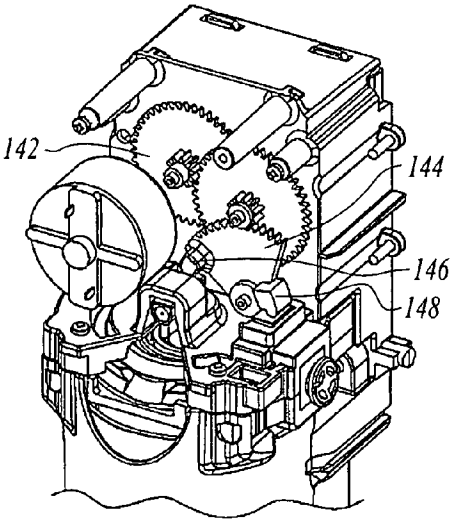
FIG. 9A is a partial view of the aerosol dispensing system of FIG. 5 with a user interface component and a control circuit removed and shows a multi-functional hammer assembly in an inactive position.

As mentioned above, the container 112 can be automatically released using an electronic circuit and/or electromechanical mechanism, which can be programmed or operable to release the container after a predetermined number of doses of material in the container are emitted, or after a predetermined amount of time. For example, as more fully described below, automatic release can be achieved with a control circuit 140 (FIGS. 4 and 5), a drive assembly 142 (FIGS. 9A-9C), a multi-functional hammer assembly 144 (FIGS. 9A-9C). The control circuit 140 controls the drive assembly 142, and the drive assembly 142 operates to drive the hammer assembly 144. The control circuit can include a processor, and a counter for counting a predetermined number of doses after a new container is inserted, or a timer for indicating the end of a predetermined lifespan of the substance (such as aerosol) in the container after a new container is inserted. In either case, the insertion of a new container can operate to reset the counter or the timer, such as when the container contacts a micro-switch or similar part upon insertion. The detection of a new container can be communicated to a control assembly (see below) and act to reset a lifespan indicator, such as the output of a timer or counter. The hammer assembly 144 can provide multiple functions, such as actuating the aerosol spray head 118 to release material from the container in a series of spray doses, and actuating the container release actuator 108 to release the container from the container securing mechanism 114.

FIGS. 4 and 5 also illustrate a user interface component 134 that includes a display 136, such as an LCD display, and a set of control buttons 138, which interface with the control circuit 140, and which are operable to control various aspects of the system 100. The display 136 can display information regarding the state/status of the system 100, such as number of doses remaining, amount of time remaining for the lifespan of the container, remaining lifespan of a battery, whether an auto-drop feature is ON (activated) or OFF (not activated), and/or whether the spray is ON or OFF. The set of control buttons 138 can be used to enter instructions/commands for the use of the system 100, and these instructions/commands can include a desired amount of time between doses or other scheduling information; a desired spray pattern; a desired amount of material per dose; a reset command when a new container is inserted; and/or various others.

Figure 6:
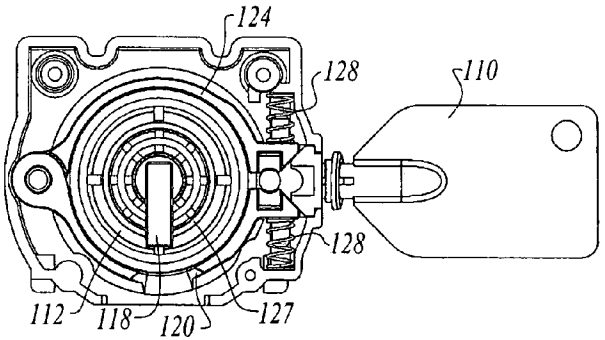
FIG. 6 is a top, cross-sectional view of the aerosol dispensing system of FIGS. 2 and 4 with an aerosol container in the fully engaged position and supported by the container securing mechanism.
Figure 7:
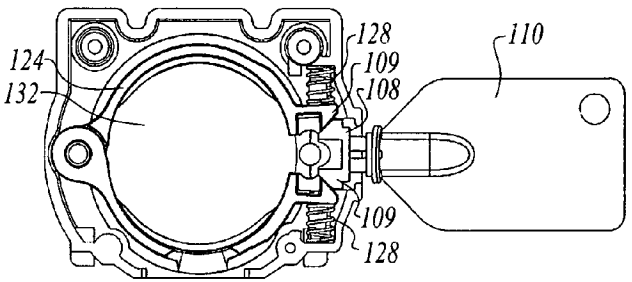
FIG. 7 is a top, cross-sectional view of the aerosol dispensing system of FIG. 5, showing the container securing mechanism without an aerosol container in place.

FIG. 6 shows a top view of the aerosol dispensing system with container 112 fully inserted and secured. FIG. 7 shows the same top view shown in FIG. 6 but with the container removed illustrating aperture 132. Although the container securing mechanism can secure the container at various points, as shown in this embodiment, the container securing mechanism 114 includes an expandable retaining ring 124 configured to engage a recessed track 126 (see FIG. 5) extending around the circumference of a piece 127 located on an upper portion of the container 112. A recessed track can also be formed on the container itself. The upper portion of the container can be generally frustoconical in shape, which aids in the insertion process. The expansion of the retaining ring 124 for release of the container can be actuated by, for example, turning or inserting a key 110, to move actuator 108, which acts as a wedge against the angled edges 109 of the retaining ring, which are normally biased in a first position as shown in FIG. 6 by one or more springs 128.

Piece 127 (or the container 112) can also include one or more mating features (such as concentric male or female rings), which can mate with corresponding complementary mating features (such as female or male rings) of the dispensing system 100. This can provide lockout of a container that does not have the appropriate mating feature, and can be advantageous to ensure that only a desired type of container be used with the dispensing system 100.

Upon insertion of a container 112, the retaining ring can expand simply by the force exerted by the container 112 being pushed through the retaining ring from below.

Figure 8:
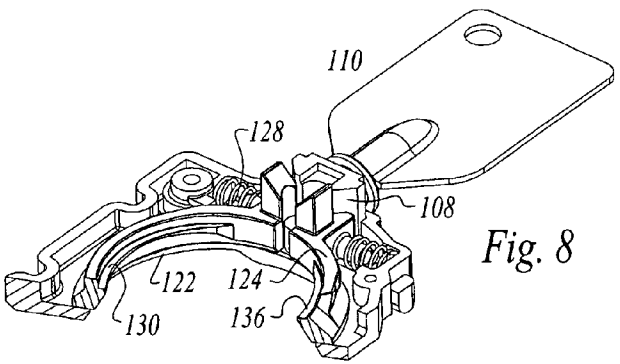
FIG. 8 is a perspective, partially cut-away view of the container securing mechanism and the container stop mechanism of FIG. 7 with a key ready to engage the container release actuator.

FIG. 8 is a partially cut away view of the container securing mechanism 114 and container stop mechanism 122. Again, the container securing mechanism 122 is an expandable retaining ring 124 actuated in part by a spring 128, which is itself actuated by key 110. The expandable retaining ring 124 can include a plurality of bumpers 130 (which engage track 126) disposed around aperture 132 through which the container falls when the container is in a fully engaged position and through which the container is inserted when it is fully inserted into the system. Additionally, the container stop mechanism 122, which is located below the securing mechanism, can be formed as a continuous ring as shown, or also as a discontinuous ring of bumpers, disposed around an aperture 132. The ring is positioned and sized to provide a friction fit around the container, such that the container is prevented from fully disengaging from the aerosol dispensing system once it has been released from the container securing mechanism. Although the container stop mechanism 122 in the embodiment of FIG. 8 is located below and in close proximity to the container securing mechanism 124, it can include other components also, and one or more of such components can be located at other locations inside, or even outside, the housing of the aerosol dispensing system.

FIG. 9A is a partial view of the aerosol dispensing system of FIG. 5 with the user interface component and control circuit removed and shows the hammer assembly 144 in an inactive position. In one example, the hammer assembly 144 includes a first hammer head 146 and a second hammer head 148. As illustrated, both hammer heads are located on a single driven part, allowing both to be moved with a single driving assembly (and thus a single motor), although in other embodiments, each head could be moved independently.

Figure 10B:
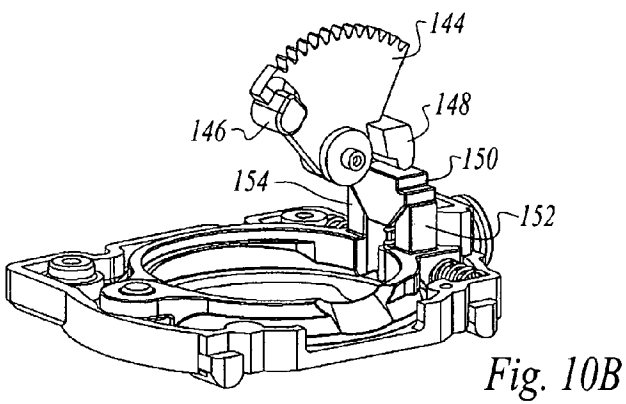
FIGS. 10A and 10B are partial perspective views of the aerosol dispensing system of FIG. 1 and show the securing mechanism and the hammer assembly and operation of the hammer assembly as it automatically contacts the container release actuator for, releasing the container.
Figure 10A:
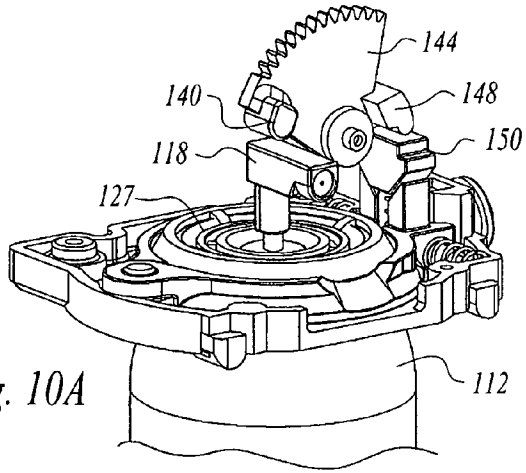

FIG. 9B shows the first hammer head 146 which has been moved in the direction of the arrow (down and to the left) from the position illustrated in FIG. 9A by the driving assembly 142 such that it can hit an actuator, such as the spray head 118, to release material from the container 112. A perspective view of this is shown in FIG. 10A.

Figure 11B:
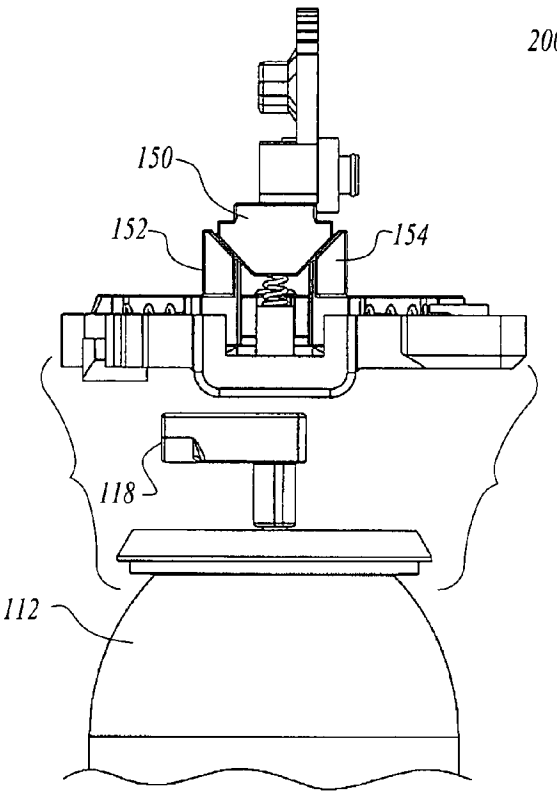
FIGS. 11A and 11B are partial side views of the aerosol dispensing system of FIG. 1 and show operation of the hammer assembly and in particular the second hammer head of the hammer assembly for automatically releasing the container.
Figure 11A:
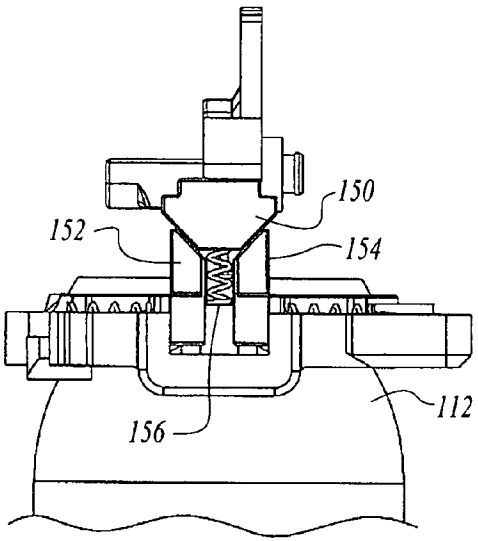

FIG. 9C shows the second hammer head 148 which has been moved in the direction of the arrow (down and to the right) from the position illustrated in FIG. 9A such that it can expand the expandable retaining ring 124 to release the container 112 from the container securing mechanism 114. A perspective view of this is shown in FIG. 10B, and side views are shown in FIGS. 11A and 11B, which also better illustrate an actuator in the form of a wedge 150 normally biased upward by spring 156, and angled posts 152, 154, which are moved apart when the wedge is forced downwardly by movement of the second hammer head in the direction to hit the wedge 150.

Figure 12:
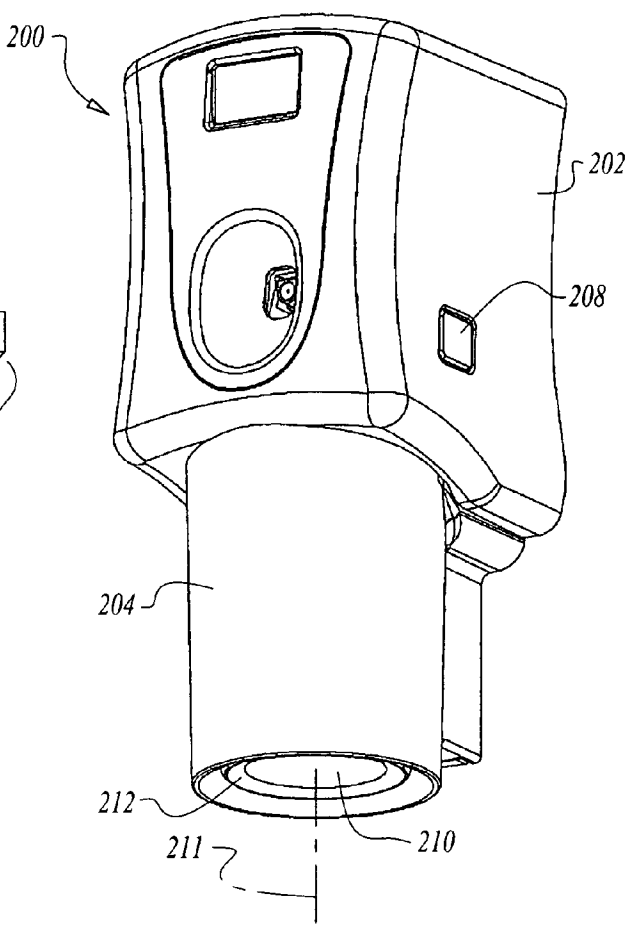
FIG. 12 is an illustration of another exemplary aerosol dispensing system in which an aerosol container is in a fully engaged position within a system housing.

FIG. 12 shows another embodiment of an aerosol dispensing system 200 and illustrates an inserted container 212. As in the previous embodiment, this embodiment includes a housing with an upper cover 202, a lower cover 204, an aerosol spray opening 206, a container release actuator which operates similarly to actuator 108 described above, and which can be manually operated in keyless manner by pressing a button 208. Container 212 is inserted and released along 211 via container refill port 210.

Figure 13:
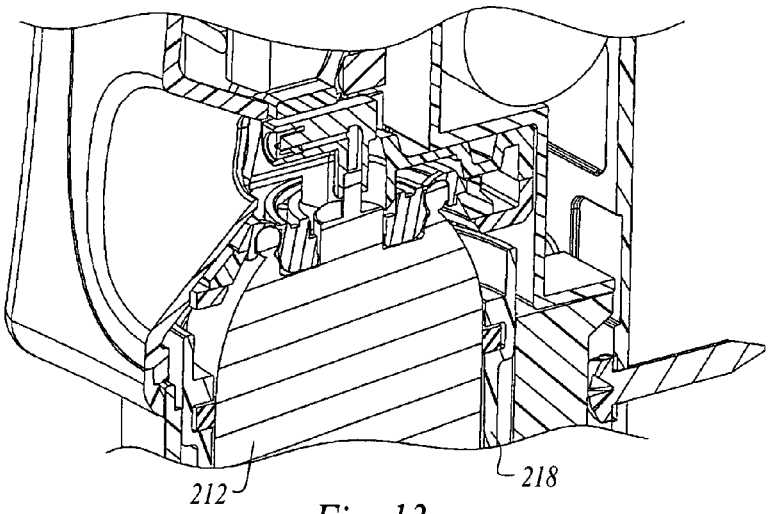
FIG. 13 is a partially cut out view of part of the aerosol dispensing system of FIG. 12 with an aerosol container in a fully engaged position.
Figure 14:
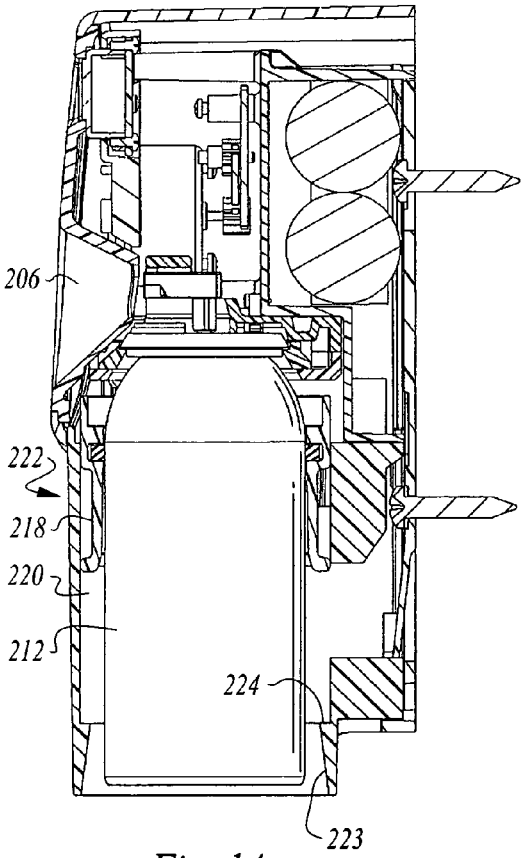
FIG. 14 is a cross-sectional view of the aerosol dispensing system of FIG. 12 with the aerosol container in a fully engaged position.
Figure 15:
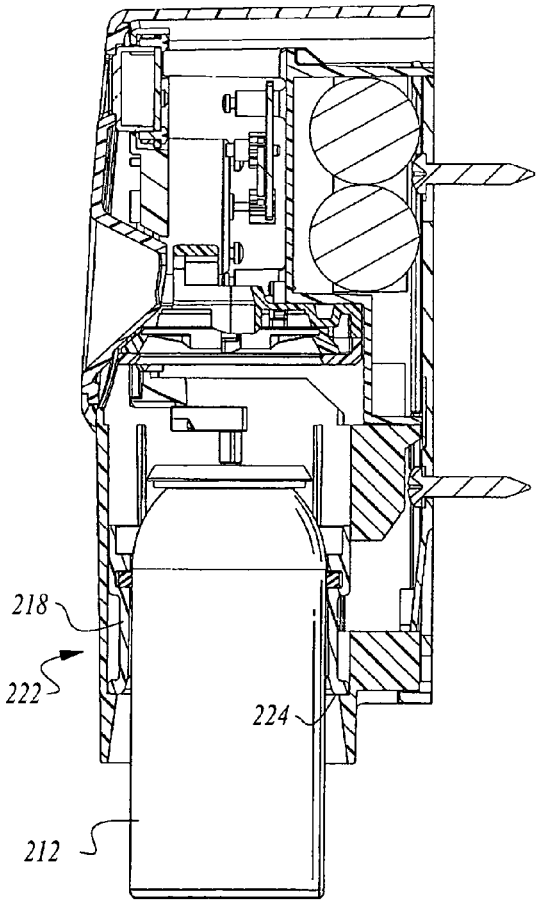
FIG. 15 is a cross-sectional view of the aerosol dispensing system of FIG. 12 with the aerosol container in a disengaged position.

In this embodiment, as shown in FIGS. 13-15, a container stop mechanism 222 allows for stopping the container when the container is released or inserted, and can include a flexible plastic ring 218 that is configured to engage the container 212 and move with the container 212 longitudinally along the axis 211 of container insertion within channel 220 formed in an inside surface 223 of the bottom cover 204 in order to optimize the placement and release of the container. FIGS. 13 and 14 show container 212 in the aerosol dispensing system 200 of FIG. 12 with the container in a fully secured position, and FIG. 15 shows container 212 in a disengaged or partially released position.

The container stop mechanism 222 also serves as a container guide to facilitate the alignment when inserting the container into the dispensing system 200. The container 212 is inserted through the ring 218 which includes one or more contact surfaces configured to provide a friction fit with the container 212. The ring 218 and container 212 are then movable along the channel 220 but are constrained by one or more stops such as stop 224.

In use, the container stop mechanism 222 engages with a container when a user pushes the container through the ring 218. Once the container has been engaged, the ring 218 travels upward along with the container in the channel 220, guiding it into the fully inserted position, as shown in FIGS. 13 and 14, where it is secured by the container securing mechanism (not shown). Upon release of the container from the container securing mechanism 222, the ring 218 travels downward along with the container to the partially engaged position, where the ring is stopped by stop 224 and the container 212 can then be accessed and removed by a user.

Figure 16B:
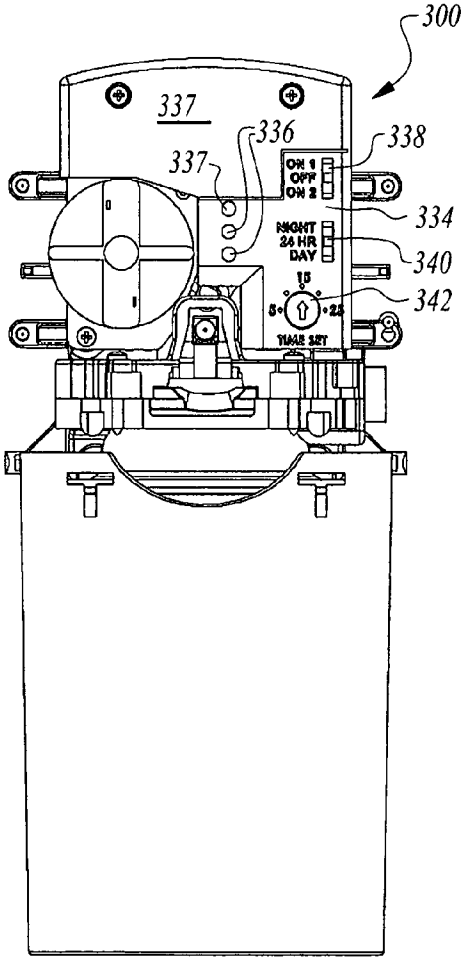
FIG. 16B is a front view of the dispensing system of FIG. 16A with the upper cover removed.
Figure 16A:
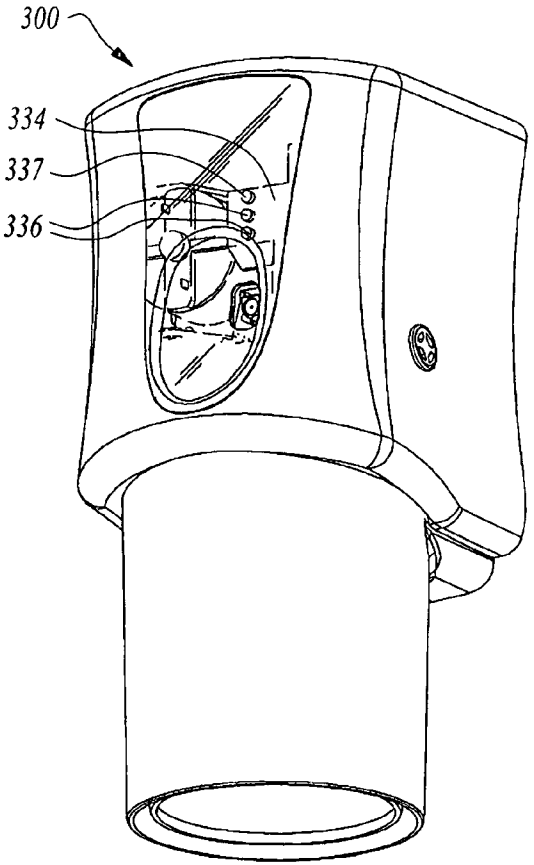
FIG. 16A is an illustration of another exemplary dispensing system and shows an LED display.

FIGS. 16A and 16B illustrate another embodiment of a dispensing system 300, one which includes a user interface component 334 which includes a set of LEDs 336. The user interface component 334 can include various switches to perform, various functions, and these switches can include a switch 338 to turn the system on from an OFF position, where for example, ON 1 would activate the automatic release function, and ON 2 would not activate the automatic release function. Another switch 340 can operate to activate the automatic dispensing at various predetermined times, such as only during the day, only during the night only, or all the time. A further switch, shown as a rotational switch 342, can be used to set the frequency of the doses to be emitted. The LEDs can be used to indicate various functions such as the unit is on, the battery power is low, the amount of material in the container is low, as well as others. The user interface component can also include a sensor 337 in the form of an IR transmitter/receiver which can be used as a day/night detector, and this information can be used to determine desired scheduling of the doses of material in the container.

Figure 17:
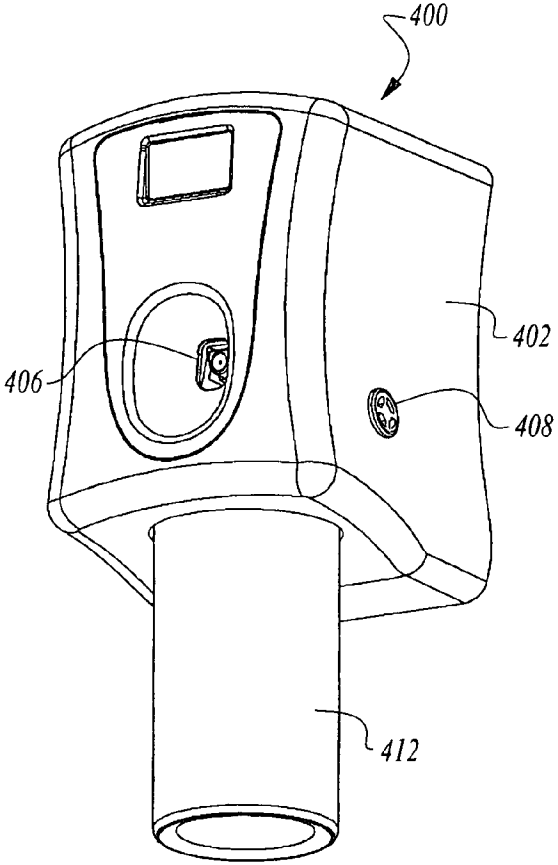
FIG. 17 is a perspective view of another exemplary aerosol dispensing system that does not include a lower housing portion, such that a fully engaged container extends partially below the dispensing system.

FIG. 17 shows another embodiment of a dispensing system 400, and as in the previous embodiment, this embodiment includes a housing with an upper cover 402, but no lower cover, an aerosol spray opening 406, and a container release actuator 408, shown here in the form of a keyed mechanism. An inserted container 412 in a fully secured position extends below the system 400. As noted above, the absence of a lower cover can be advantageous from a branding standpoint because graphics and/or text can be placed on the container and be easily visible by room occupants.

Figure 18:
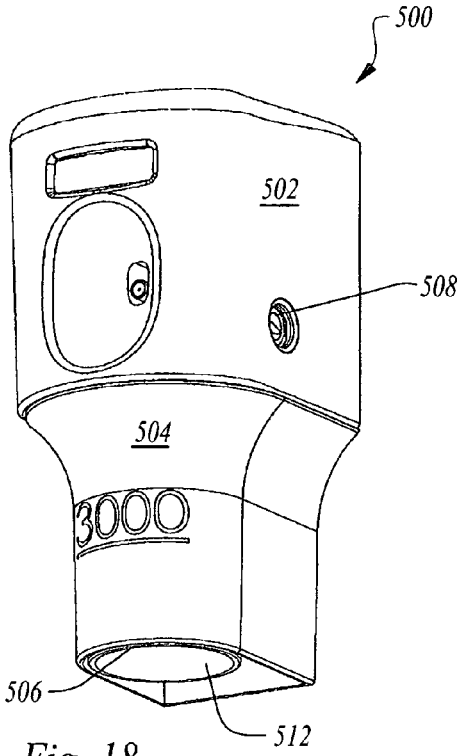
FIG. 18 shows a perspective view of another embodiment of aerosol dispensing system in which an aerosol canister is in a fully engaged position within a system housing.
Figure 19:
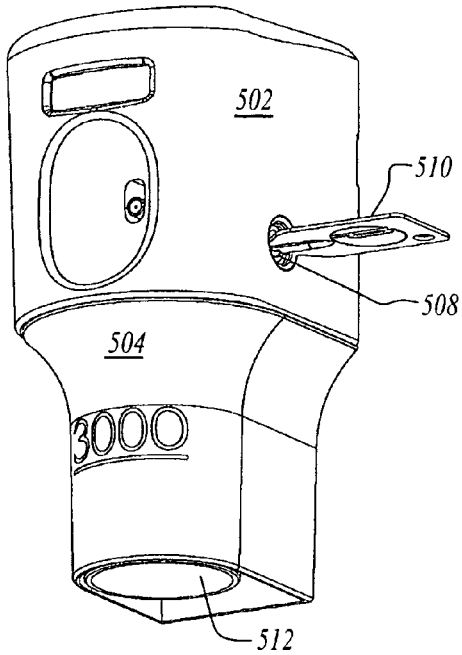
FIG. 19 shows the aerosol dispensing system of FIG. 18 with a key engaged with the canister release actuator.
Figure 20:
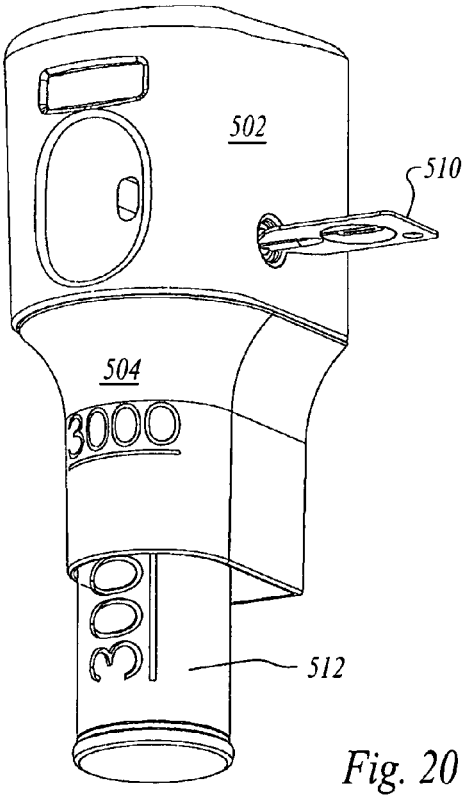
FIG. 20 shows a canister in a disengaged position after the canister is partially released from the aerosol dispensing system of FIG. 19 and supported by the canister stop mechanism.

FIG. 18 shows in perspective view an aerosol dispensing system 500. This system can be used to dispense a variety of fragrance technologies, such as aerosol propellants. In this embodiment, the system includes a two-part housing comprising an upper cover 502 configured to cover the aerosol spray mechanism and a lower cover 504 configured to cover at least a portion of an aerosol canister 512. In some embodiments, the housing, upper cover, and/or lower cover are absent. A canister refill port 506 is located at the bottom of the dispensing system and serves as a location to insert or remove an aerosol canister. A canister release actuator 508 is accessible through the housing. This actuator can take the form of, for example, a "no key" (e.g., a button) or "keyed" mechanism. FIG. 19 shows the insertion of a key 510 to release an aerosol can from the system. The key can be of any design to maximize or minimize level of security. FIG. 20 illustrates the ejection of an aerosol can 512 upon the actuation of key 510.

Inside the housing there is a stop mechanism that prevents the can from falling completely out through the canister refill port upon release. For example, the stop mechanism can take the form of a friction fit between the opening of the refill port 506 and/or one or more contact areas between the canister and a canister refill channel with the housing. Examples of friction-based stopping mechanisms are depicted in more detail in FIGS. 22, 25, 28-33. Once the canister has been stopped, the user can pull the canister fully from the aerosol dispensing system. The stop mechanism also assists the user in the replacement of the canister. For example, the user can push the canister in the housing until it engages with the stop mechanism. Then, the user can release the canister with no concern that it will fall away from the aerosol dispensing system. The user can then push the canister into the housing until it is fully in place within the protective housing.

Figure 21:
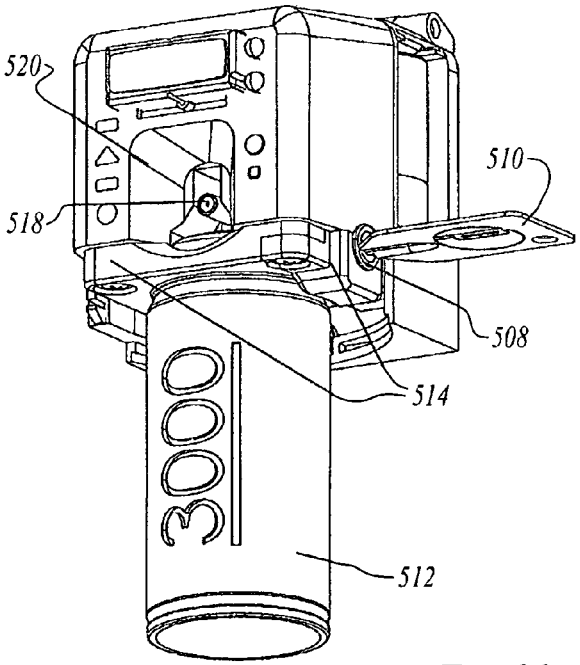
FIG. 21 shows the aerosol dispensing system of FIG. 19 with the lower cover and the front panel of the upper cover removed.

FIG. 21 shows an interior view of the aerosol delivery system of FIG. 18 with the upper cover removed. Here, the aerosol canister 512 is fully inserted in the housing, such that it engages a canister securing mechanism 514, which is configured to "lock" the canister in place. As shown in FIG. 21, the canister securing mechanism 514 is in operable communication with the canister release actuator 508. A more detailed description of the canister securing mechanism is provided in association with FIGS. 22-25. When the canister is fully inserted into the system, its aerosol spray head 518 is aligned with an opening 520 that extends through the upper cover 502 of the housing and allows the aerosol spray to exit the aerosol dispensing system.

Figure 22:
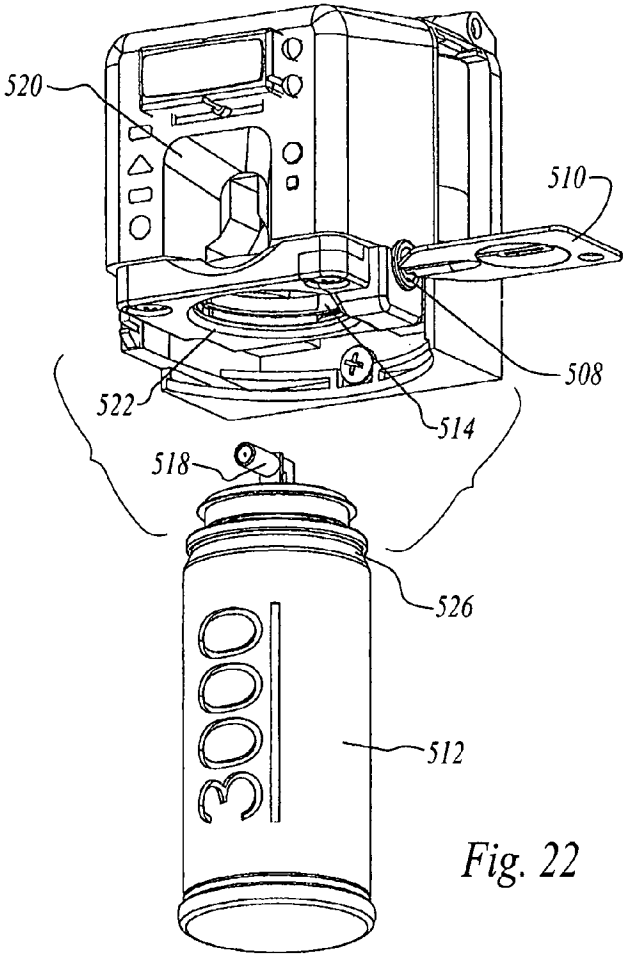
FIG. 22 shows the aerosol dispensing system of FIG. 20 with the lower cover and the front panel of the upper cover removed and the canister in the disengaged position.

FIG. 22 shows an aerosol dispensing system without a lower cover over the aerosol canister. In this embodiment, a stop mechanism 522 in the form of, for example, an 0-ring or rubber gasket is provided immediately below the canister securing mechanism 514.

Figure 23:
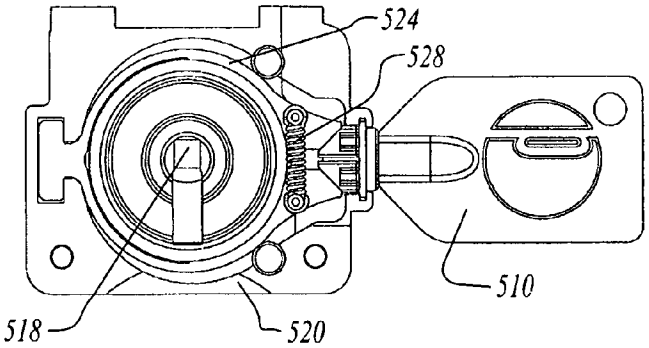
FIG. 23 shows a top, cross-sectional view of the aerosol dispensing system of FIGS. 19 and 21 with an aerosol canister in the fully engaged position and supported by the canister securing mechanism.
Figure 24:
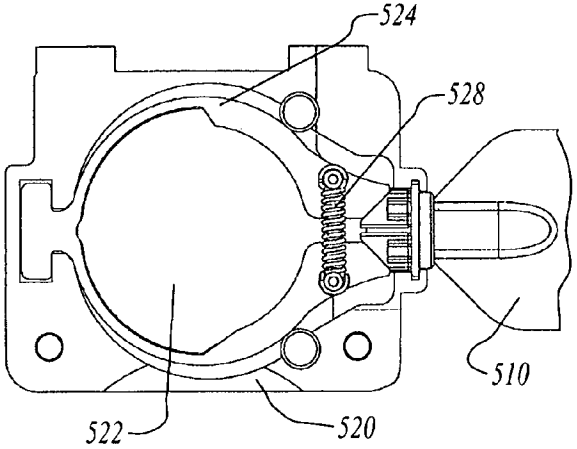
FIG. 24 shows a top, cross-sectional view of the aerosol dispensing system of FIGS. 20 and 22, including the canister securing mechanism without an aerosol canister in place.

FIG. 23 shows a top view of the aerosol dispensing system with canister 512 fully inserted. In this embodiment, the canister securing mechanism includes an expandable retaining ring 524 configured to engage a recessed track 526 extending around the circumference of an upper portion of the canister. The expansion of the retaining ring can be actuated by, for example, a spring 528 which can be actuated by key 510, or simply by the force exerted by the canister being pushed through the retaining ring from below. FIG. 24 shows the top view of FIG. 23 with the canister removed.

Figure 25:
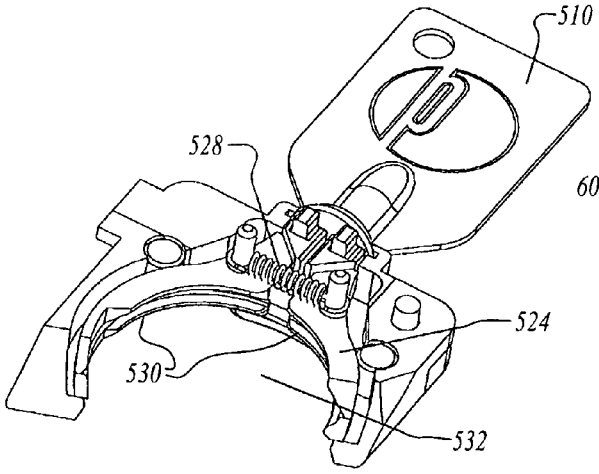
FIG. 25 shows a partially cut-away view of the canister securing mechanism and the canister stop mechanism of FIG. 24.

FIG. 25 is a partially cut away view of the canister securing and stop mechanisms. Here, again, the canister securing mechanism is an expandable retaining ring 524 actuated by a spring 528, which is itself actuated by key 510. The canister stop mechanism, which is located below the securing mechanism, includes a plurality of bumpers 530 disposed around an aperture 532 through which the canister is inserted when it is fully inserted into the system. These bumpers are positioned and sized to provide a friction fit around the canister, such that the canister is prevented from fully disengaging from the aerosol dispensing system once it has been released from the canister securing mechanism. Although the canister stopping mechanism in the embodiment of FIG. 25 is located below and in close proximity to the canister securing mechanism, it can be located at other locations inside, or even outside, the housing of the aerosol dispensing system.

Figure 26:
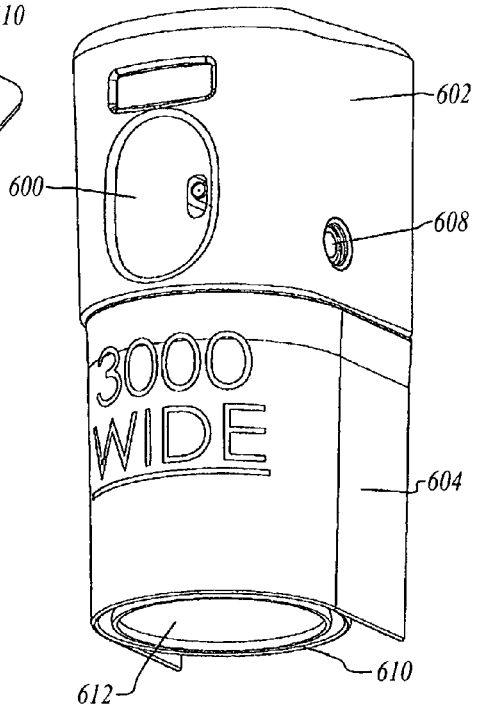
FIG. 26 shows another embodiment of an aerosol dispensing system in which an aerosol canister is in a fully engaged position within a system housing.
Figure 27:
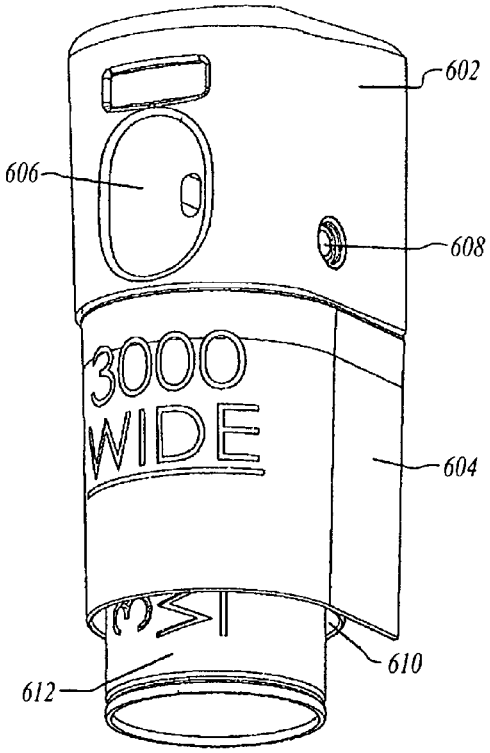
FIG. 27 shows the aerosol dispensing system of FIG. 26 with a canister in a disengaged position and secured by the canister stop mechanism.

FIG. 26 shows another embodiment of an aerosol dispensing system 600. As in the previous embodiment, this alternative embodiment includes a housing with an upper cover 602, a lower cover 604, an aerosol spray opening 606, a canister release actuator 608 and a canister refill port 610. However, in this embodiment, the canister stop mechanism is configured to move longitudinally along the axis of canister insertion in order to optimize the placement and release of the canister. FIG. 27 shows a canister 612 in the aerosol dispensing system of FIG. 26. As depicted here, the canister 612 is not fully inserted into the system, but is retained partially within the housing by the canister stop mechanism.

Figure 28:
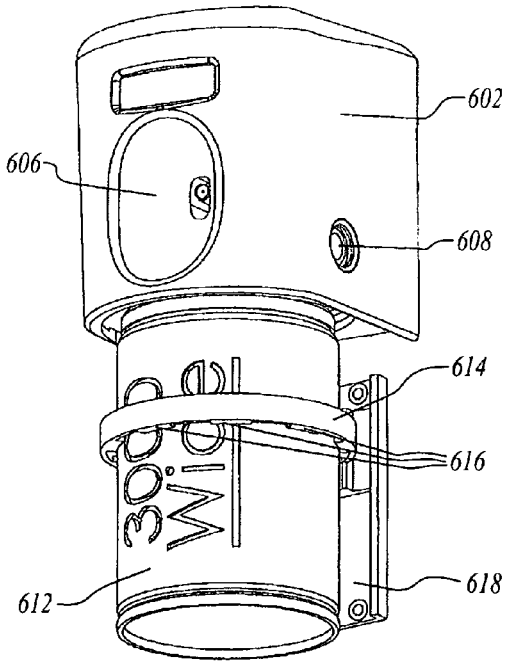
FIG. 28 shows the aerosol dispensing system of FIG. 26 with the lower cover removed and the canister stop mechanism with an aerosol canister in the fully engaged position.

FIG. 28 shows the aerosol dispensing system of FIG. 27 with the lower cover removed to expose the canister stop mechanism. In this embodiment, the canister stop mechanism also serves as a canister guide to facilitate the alignment and insertion of the canister into the fully engaged position. The canister stop mechanism includes a guide ring 614 through which the canister 612 can be inserted, and further includes one or more contact surfaces 616 configured to provide a friction fit with the canister. The guide ring is movably connected to a support plate 618 by, for example, one or more rails (not shown).

In the embodiment, the canister stop mechanism engages with a canister when a user pushes the canister through the guide ring. Once the canister has been engaged, the canister stop mechanism travels upward along with the canister, guiding it into the fully inserted position, shown in FIG. 28, where it is secured by the canister securing mechanism. Upon release of the canister from the canister securing mechanism, the guide ring travels downward along with the canister into a position where it can be accessed and removed by a user, as shown in FIG. 29.

Figure 29:
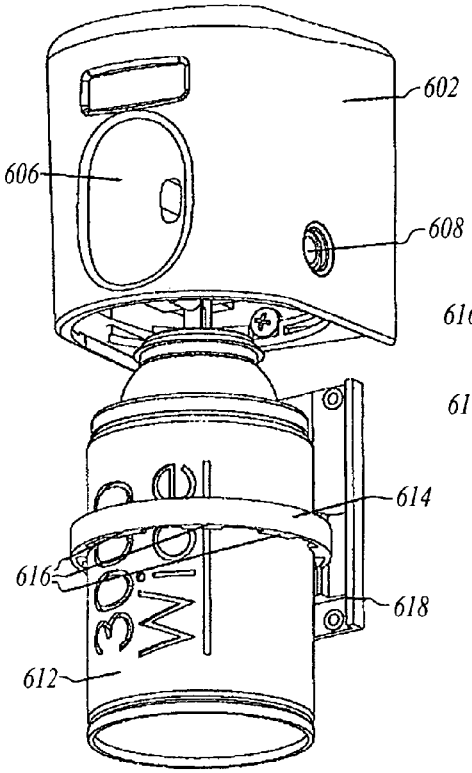
FIG. 29 shows the aerosol dispensing system of FIG. 27 with the lower cover removed and the canister stop mechanism with an aerosol canister in a disengaged position.
Figure 30:
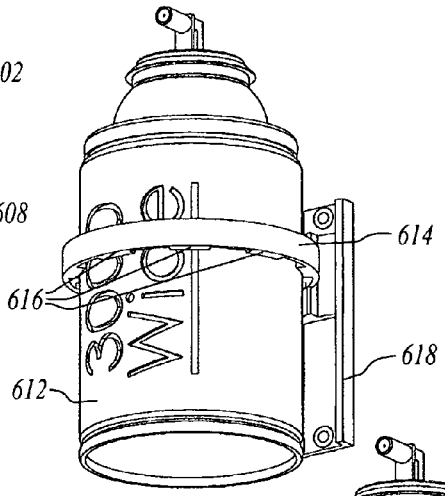
FIG. 30 shows the canister stop mechanism of FIG. 20 with an aerosol canister in the fully engaged position, with the housing removed.
Figure 31:
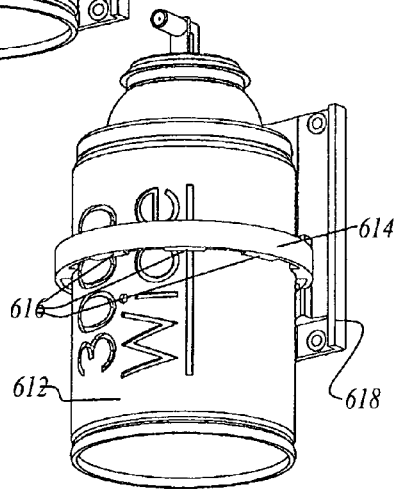
FIG. 31 shows the canister stop mechanism of FIG. 27 with an aerosol canister in the disengaged position, with the housing removed.

FIG. 30 shows a canister in the fully inserted position in the canister stop mechanism of FIGS. 28 and 29. FIG. 31 shows a canister in the released position in the canister stop mechanism of FIGS. 28 and 29.

Figure 32:
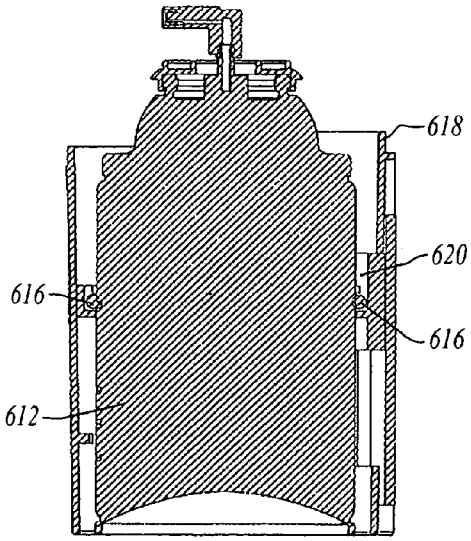
FIG. 32 shows a cross-section view of the canister stop mechanism and canister of FIG. 30 in the fully engaged position.
Figure 33:
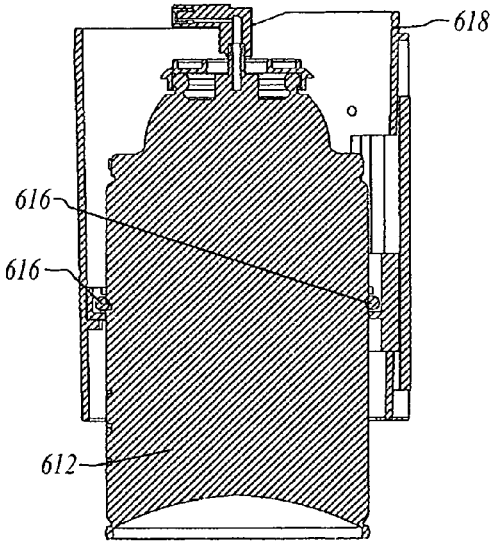
FIG. 33 shows a cross-section view of the canister stop mechanism and canister of FIG. 31 in the disengaged position.

FIG. 32 shows a cross-sectional view of the canister and canister stop mechanism of FIG. 30, including two contact points 616 that provide the friction fit and a zero or very low friction housing 620 for the stop mechanism. FIG. 33 shows a cross-sectional view of the canister and canister stop mechanism of FIG. 31.

It is specifically intended that the present invention not be limited to the embodiments and illustrations contained herein, but include modified forms of those embodiments including portions of the embodiments and combinations of portions of different embodiments as come within the scope of the following claims.

The invention claimed is:

1. A dispensing system comprising, in combination:

a container securing mechanism configured to secure a container in a fully engaged position suitable for dispensation of a substance in the container and further configured to selectively alternatively support said container in said fully engaged position or release the container from the fully engaged position and allow said container to fall downwardly under the influence of gravity;

a container release actuator operatively associated with said container securing mechanism to release the container from the fully engaged position; and a container stop mechanism below said container securing mechanism configured to stop the container and limit downward movement of the container under the influence of gravity to a disengaged position upon release of the container from the container securing mechanism responsive to actuation of said container release actuator, the disengaged position being between the fully engaged position and a fully released position in which the container is fully released from the system, said container stop mechanism operable to engage said container whereby a downwardly directed force of sufficient magnitude exerted on said container will be operable to cause separation of said container from said stop mechanism and allow movement of said container to said fully released position, the container moving along the same path of movement both when the container is inserted into said dispensing system and when the container is removed from said dispensing system, said container stop mechanism being a friction-based mechanism comprising a gasket or O-ring adapted to fit around the container.

2. A dispensing system comprising:

an automatically actuated container release actuator; and a container securing mechanism configured to secure a container in a fully engaged position suitable for dispensation of a substance in the container and further configured to release the container from the fully engaged position upon the actuation of the container release actuator, said container being inserted and removed at the bottom of the system and movable along a substantially vertical axis during both insertion and removal, the container securing mechanism comprising an expandable retaining ring configured to engage a recessed track around the circumference of a container, and wherein the container release actuator is actuated using a hammer assembly including a first hammer head for causing material to be emitted from the container and a second hammer head for actuating the container release actuator.

3. The dispensing system of claim 2 further including a control assembly and a drive assembly, wherein the control assembly controls operation of the drive assembly which drives the hammer assembly.

4. The dispensing system of claim 3 wherein the first hammer head and the second hammer head are moved together and the drive assembly includes a single motor to drive the first hammer head and the second hammer head.

5. The dispensing system of claim 4 wherein the container release actuator is automatically actuated after a predetermined number of doses or after a predetermined amount of time.

6. The dispensing system of claim 4 further including a mechanism to detect the insertion of a new container.

7. The dispensing system of claim 6 wherein the mechanism is a micro-switch and the detection of a new container is used by a control assembly to reset a lifespan indicator.

8. The dispensing system of claim 2 further including a container stop mechanism that is configured to stop the container in a disengaged position upon release of the container from the container securing mechanism, the disengaged position being between the fully engaged position and a position in which the container is fully released from the system.

9. The dispensing system of claim 8 wherein the container stop mechanism is a friction-based mechanism.

10. The dispensing system of claim 8 wherein the friction-based mechanism comprises one of a gasket and a ring adapted to fit around and engage the container.

11. The dispensing system of claim 8 wherein the container stop mechanism comprises a guide ring configured to engage the container and a support structure, the guide ring being movably connected to the support structure such that the guide ring moves with the container along the axis corresponding to the direction of container insertion and release.

12. A dispensing system comprising:

a canister securing mechanism configured to secure a canister in a fully engaged position suitable for dispensation of a substance in the canister and further configured to release the canister from the fully engaged position upon the actuation of a canister release actuator; and a canister stop mechanism configured to stop the canister in a disengaged position upon release of the canister from the canister securing mechanism, the disengaged position being between the fully engaged position and a position in which the canister is fully released from the system, said canister securing mechanism comprising an expandable retaining ring configured to engage a recessed track around the circumference of a canister and said retaining ring actuated by a spring.

13. The dispensing system of claim 12 further comprising a housing, wherein the canister securing mechanism is configured to secure a canister within the housing when the canister is in the fully engaged position and the canister stop mechanism is configured such that at least a portion of the canister extends outside the housing when the canister is in the disengaged position.

14. The system dispensing of claim 12 wherein the spring is actuated by a key.

15. The dispensing system of claim 12 wherein the canister stop mechanism is a friction-based mechanism.

16. The dispensing system of claim 15 wherein the friction-based mechanism comprises a gasket or 0-ring adapted to fit around the canister.

17. The dispensing system of claim 12 wherein the canister stop mechanism comprises a guide ring configured to engage the canister and a support plate, the guide ring being movably connected to the support plate such that the guide ring moves with the canister along the axis corresponding to the direction of canister insertion and release.

18. A method of using the dispensing system of claim 12, the dispensing system including a canister secured in the fully engaged position by the canister securing mechanism, the method comprising releasing the canister from the canister securing mechanism by actuating the canister release actuator, whereby the canister stop mechanism stops the released canister in the disengaged position.

19. A method of using the dispensing system of claim 12, the method comprising inserting a canister into the canister stop mechanism, releasing the canister such that it is held in the disengaged position by the canister stop mechanism, and subsequently inserting the canister into the canister securing mechanism in the fully engaged position.

20. A dispensing system comprising, in combination:

a container securing mechanism configured to secure a container in a fully engaged position suitable for dispensation of a substance in the container and further configured to selectively alternatively support said container in said fully engaged position or release the container from the fully engaged position and allow said container to fall downwardly under the influence of gravity;

a container release actuator operatively associated with said container securing mechanism to release the container from the fully engaged position;

a container stop mechanism below said container securing mechanism configured to stop the container and limit downward movement of the container under the influence of gravity to a disengaged position upon release of the container from the container securing mechanism responsive to actuation of said container release actuator, the disengaged position being between the fully engaged position and a fully released position in which the container is fully released from the system, said container stop mechanism operable to engage said container whereby a downwardly directed force of sufficient magnitude exerted on said container will be operable to cause separation of said container from said stop mechanism and allow movement of said container to said fully released position, the container moving along the same path of movement both when the container is inserted into said dispensing system and when the container is removed from said dispensing system; and a support plate, the container stop mechanism comprising a container support configured to engage the container and the support plate, the container support being movably connected to the support plate such that the container support moves with the container along an axis corresponding to the direction of container insertion and release.

* * * * *